US005800075A

United States Patent [19]

Katsuma et al.

[11] Patent Number: 5,800,075

[45] Date of Patent: Sep. 1, 1998

[54] DATA PROCESSING METHOD FOR ELIMINATING INFLUENCE OF HEAT ACCUMULATING IN THERMAL HEAD

[75] Inventors: Nobuo Katsuma; Hisashi Enomoto, both of Saitama, Japan

[73] Assignee: Fuji Photo Film Co., Ltd., Kanagawa, Japan

[21] Appl. No.: 827,606

[22] Filed: Apr. 9, 1997

[30] Foreign Application Priority Data

Apr. 11, 1996 [JP] Japan ..... 8-089354

[51] Int. Cl.[6] ..... B41J 2/365

[52] U.S. Cl. ..... 400/120.14; 347/188

[58] Field of Search ..... 400/120.14, 120.15, 400/124.13; 347/188, 202

[56] References Cited

U.S. PATENT DOCUMENTS 5,324,121 6/1994 Sasaki et al. ..... 347/202
5,661,513 8/1997 Shirakawa et al. ..... 347/202
5,677,062 10/1997 Kuroda et al. ..... 347/202

*Primary Examiner*—Edgar S. Burr
*Assistant Examiner*—Steven S. Kelley

[57] ABSTRACT

A data processing apparatus for correcting heating data for a thermal head to eliminate influence of heat accumulation in the thermal head on recording density. The apparatus is comprised of a correction circuit having a subtracter for subtracting first correction data from original heating data of a subject line to print, in pixel-to-pixel correspondence; and first to Nth operation circuits provided in correspondence with first to Nth heat accumulating layers of the thermal head respectively. The first operation circuit has a register storing first heat accumulation data for one line, a multiplier for multiplying the stored first heat accumulation data by a coefficient to provide the first correction data; a multiplier for multiplying the original or the corrected heating data of the subject line by a coefficient to provide a first value for each pixel of the subject line; a multiplier for multiplying the stored first heat accumulation data by a coefficient to provide a second value for each pixel of one line; and an adder for adding the first and second values in pixel-to-pixel correspondence. A new series of first heat accumulation data is obtained from output data of the first adder, and is stored in the register in place of the previously stored first heat accumulation data. The Jth operation circuit, J being 2 to N, has the same construction as the first operation circuit, and prepares Jth heat accumulation data based on previously stored Jth and (J−1)th heat accumulation data, to provide Jth correction data based on the Jth heat accumulation data.

24 Claims, 7 Drawing Sheets

DATA PROCESSING METHOD FOR ELIMINATING INFLUENCE OF HEAT ACCUMULATING IN THERMAL HEAD

BACKGROUND OF THE INVENTION

1. Field of the Invention

The present invention relates to a data processing method for correcting heating data for a thermal head of a thermal printer such that print quality may not be degraded by heat energy accumulated in the thermal head.

2. Description of the Related Art

There are thermosensitive recording type thermal printers and thermal transfer type thermal printers. The former heats a thermosensitive recording sheet directly with a thermal head, to cause the sheet to develop color. The latter heats the back of an ink ribbon placed upon a recording sheet to transfer ink to the recording sheet. The thermal printer has a thermal head which has an array of heating elements arranged on a ceramic substrate. The array of heating elements correspond to a line of pixels, and the heating elements are each individually driven to record a dot at a time, so that an image is printed line by line on the recording sheet.

In the thermosensitive recording type and the sublimation ink transfer type thermal printing, one dot constitutes one pixel of the printed image, and has a variable density including a zero level, that is designated by input image data for each pixel. In case of color thermal printing using at least three primary colors, three color dots having variable densities constitute one pixel of a printed full-color image. The densities of the dots can deviate from the designated densities or the sharpness of the image can be worsened because of heat accumulation in the thermal head.

Most of heat energy generated from the heating elements is used for recording, but the rest stays unused or dissipates. The unused heat energy is mainly accumulated in a glazed layer which is formed between the heating elements and the ceramic substrate. Part of the accumulated heat energy is transmitted from the glazed layer to the ceramic substrate and is accumulated therein, or partly transmitted further to an aluminum plate supporting the substrate and is accumulated therein. From the aluminum plate, the heat energy is partly transmitted to a radiation plate, and radiates from the radiation plate. Hereinafter, the layers disposed under the heating elements will be referred to as heat accumulating layers.

The amount of accumulated heat energy depends on the past heating states or thermal history of the heating elements. In addition to the heat energy accumulated in each heating element, part of heat energy accumulated in adjacent heating elements may be transmitted and have influence on the thermal history of each heating element.

Heat accumulation can be classified into local heat accumulation or heat accumulation in a particular heating element, and overall heat accumulation or heat accumulation in the thermal head. Part of the heat energy accumulated in the heating element is added to the heat energy that is newly generated from the heating element for the next pixel. Therefore, the density of the pixel becomes higher than expected. Where density changes steeply from high to low in the original image, the change becomes gentler in the printed image. Thus, the contour or edge of the printed image becomes vague. Since the heat accumulation in the thermal head gradually increases as the recording proceeds, it results a gradual density change overall the printed image, called shading. That is, the density is generally low at the start of recording, and as the recording proceeds, it becomes higher as a whole.

The overall heat accumulation has conventionally been voided by adjusting a voltage applied to the thermal head in accordance with the temperature of the thermal head. To void the local heat accumulation, heating data of each pixel is corrected through a filtering operation. In the filtering operation, heating data of a subject pixel and peripheral pixels adjacent to the subject pixel, e.g. heating data of 3×3 to 7×7 pixels, are each individually multiplied by a coefficient allocated to the relative position to the subject pixel, and the multiplied data of all the peripheral pixels are added to the heating data of the subject pixel, thereby providing corrected heating data of the subject pixel. The corrected heating data is applied as heating data for the subject pixel to a corresponding heating element.

This filtering operation uses the same calculation process as edge enhancement that is well-known in the art of image signal processing. The edge enhancement is to increase the contrast of the image by raising the density of a high density pixel and lowering the density of a low density pixel, especially when the high and low density pixels are adjacent to each other. On the contrary, the filtering is to reproduce an original image with high fidelity by eliminating the influence of the past heating state. For this purpose, heating data of past several lines are taken into consideration to correct heating data of each pixel to record.

However, the filtering does not take account of thermal histories of the heat accumulating layers, i.e. heat accumulations in each of these layers, heat transmission or transfer between these layers, and heat radiation from these layers. Accordingly, the conventional correction of heating data is unsatisfactory for eliminating the influence of accumulated heat energy.

SUMMARY OF THE INVENTION

A prime object of the present invention is, therefore, to provide a data processing method for thermal printing, and a data processing apparatus therefor, by which the influence of heat accumulation on the quality of printed image is eliminated with accuracy, while taking the thermal histories of all layers of the thermal head.

To achieve the above object, the present invention provide a data processing method for correcting heating data for a thermal head to eliminate influence of heat accumulation in the thermal head on recording density, wherein the thermal head has an array of heating elements arranged in a line and first to Nth heat accumulating layers disposed under the heating elements in this order from the side of heating elements, and the heating elements are driven by corrected heating data to print one line after another on a recording sheet, one pixel of each line being assigned to one heating element of the array in regular sequence, the data processing method according to the present invention is comprised of the steps of:

obtaining first to Nth correction data for a subject line to print, from first to Nth heat accumulation data respectively, the first to Nth heat accumulation data being previously stored and representative of respective thermal histories of the first to Nth heat accumulating layers relating to each heating element of the array;

correcting original heating data of the subject line, with the first correction data in pixel-to-pixel correspondence, to obtain corrected heating data of the subject line;

preparing a new series of first heat accumulation data based on the original or the corrected heating data of the subject line, the previously stored first heat accumulation data, and on the second correction data obtained from the previously stored second heat accumulation data;

storing the new series of first heat accumulation data in place of the previously stored first heat accumulation data, during the recording of the subject line; preparing a new series of Jth heat accumulation data, J being 2 to N−1, based on the previously stored (J−1)th heat accumulation data, the previously stored Jth heat accumulation data, and on the (J+1)th correction data obtained from the previously stored (J+1)th heat accumulation data;

storing the new series of Jth heat accumulation data in place of the previously stored Jth heat accumulation data, during the recording of the subject line; preparing a new series of Nth heat accumulation data based on the previously stored (N−1)th heat accumulation data, and on the previously stored Nth heat accumulation data;

storing the new series of Nth heat accumulation data in place of the previously stored Nth heat accumulation data, during the recording of the subject line; obtaining new series of first to Nth correction data for a next line to print, from the newly stored first to Nth heat accumulation data respectively; and repeating the above steps for each line to print.

Another preferred data processing method of the present invention is comprised of the steps of:

obtaining first to Nth correction data for a subject line to print, from first to Nth heat accumulation data respectively, the first to Nth heat accumulation data being previously stored for one line and representative of respective thermal histories of the first to Nth heat accumulating layers relating to each heating element of the array;

correcting original heating data of the subject line with the first to Nth correction data for one line in pixel-to-pixel correspondence, to obtain corrected heating data of the subject line;

preparing a new series of first heat accumulation data based on the original or the corrected heating data of the subject line, and on the previously stored first heat accumulation data;

storing the new series of first heat accumulation data in place of the previously stored first heat accumulation data, during the recording of the subject line; preparing a new series of Jth heat accumulation data, J being 2 to N, based on the previously stored (J−1)th heat accumulation data, and on the previously stored Jth heat accumulation data;

storing the new series of Jth heat accumulation data in place of the previously stored Jth heat accumulation data, during the recording of the subject line;

obtaining new series of first to Nth correction data from the newly stored first to Nth heat accumulation data, for use in correcting heating data of a next line to print; and repeating the above steps for each line to print.

According to the present invention, a data processing apparatus for correcting heating data for a thermal head to eliminate influence of heat accumulation in the thermal head on recording density, is comprised of:

correction means having subtracting means for subtracting first correction data from original heating data of a subject line to print, in pixel-to-pixel correspondence, to correct the original heating data; and first to Nth operation circuits provided in correspondence with the first to Nth heat accumulating layers respectively, wherein the first operation circuit is comprised of:

first memory means for storing first heat accumulation data for one line, the first heat accumulation data being representative of a thermal history of the first heat accumulating layer relating to each heating element of the array;

means for multiplying the stored first heat accumulation data by a coefficient to provide the first correction data;

means for multiplying the original or the corrected heating data of the subject line by a coefficient to provide a first value for each pixel of the subject line;

means for multiplying the stored first heat accumulation data by a coefficient to provide a second value for each pixel of one line; and first adding means for adding the first and second values in pixel-to-pixel correspondence, the first adding means being connected to the first memory means to write a new series of first heat accumulation data in place of the previously stored first heat accumulation data, and wherein the Jth operation circuit, J being 2 to N, comprises:

Jth memory means for storing Jth heat accumulation data for one line, the Jth heat accumulation data being representative of a thermal history of the Jth heat accumulating layer relating to each heating element of the array;

means for multiplying the stored Jth heat accumulation data by a coefficient to provide Jth correction data;

means for multiplying (J−1)th heat accumulation data from the (J−1)th operation circuit by a coefficient to provide a third value for each pixel of one line;

means for multiplying the stored Jth heat accumulation data by a coefficient to provide a fourth value for each pixel of one line; and Jth adding means for adding the third and fourth values in pixel-to-pixel correspondence, the Jth adding means being connected to the Jth memory means to write a new series of Jth heat accumulation data in place of the previously stored Jth heat accumulation data.

According to a preferred embodiment of the data processing apparatus, the Jth correction data is sent to the (J−1)th operation circuit and is added at the (J−1)th adder of the (J−1)th operation circuit.

According to a further preferred embodiment of the data processing apparatus, the Jth correction data is sent to the correction means, and is subtracted from the original heating data of the subject line.

According to another preferred embodiment of the data processing apparatus, the first to Nth operation circuits further have first to Nth filtering means respectively, the first to Nth filtering means being connected between the first to Nth adding means, on one hand, and the first to Nth memory means, on the other hand.

According to a further embodiment, the data processing apparatus further comprises a filter circuit having a filter for filtering the first value for each pixel of one line to obtain sub-correction data for one line, and a register for storing the sub-correction data for one line during the recording of the subject line, the sub-correction data for one line being sent to the correction means, to be subtracted from original heating data of a next line to print.

According to still another embodiment of the data processing apparatus, the correction means further has means for multiplying each subtraction result by a coefficient.

It is to be noted that each of the above multiplying means can be composed of more than one multiplier, assuming that one multiplier is allocated a coefficient value. That is, "a coefficient" as mentioned above can be a product of a plurality of coefficient values.

BRIEF DESCRIPTION OF THE DRAWINGS

The above and other objects and advantages of the present invention will become apparent from the following detailed description of the preferred embodiments when read in connection with the accompanying drawings, which are given by way of illustration only and thus are not limitative of the present invention, wherein like reference numerals designate like or corresponding parts throughout the several views, and wherein.

DETAILED DESCRIPTION OF THE PREFERRED EMBODIMENT

Figure 1:
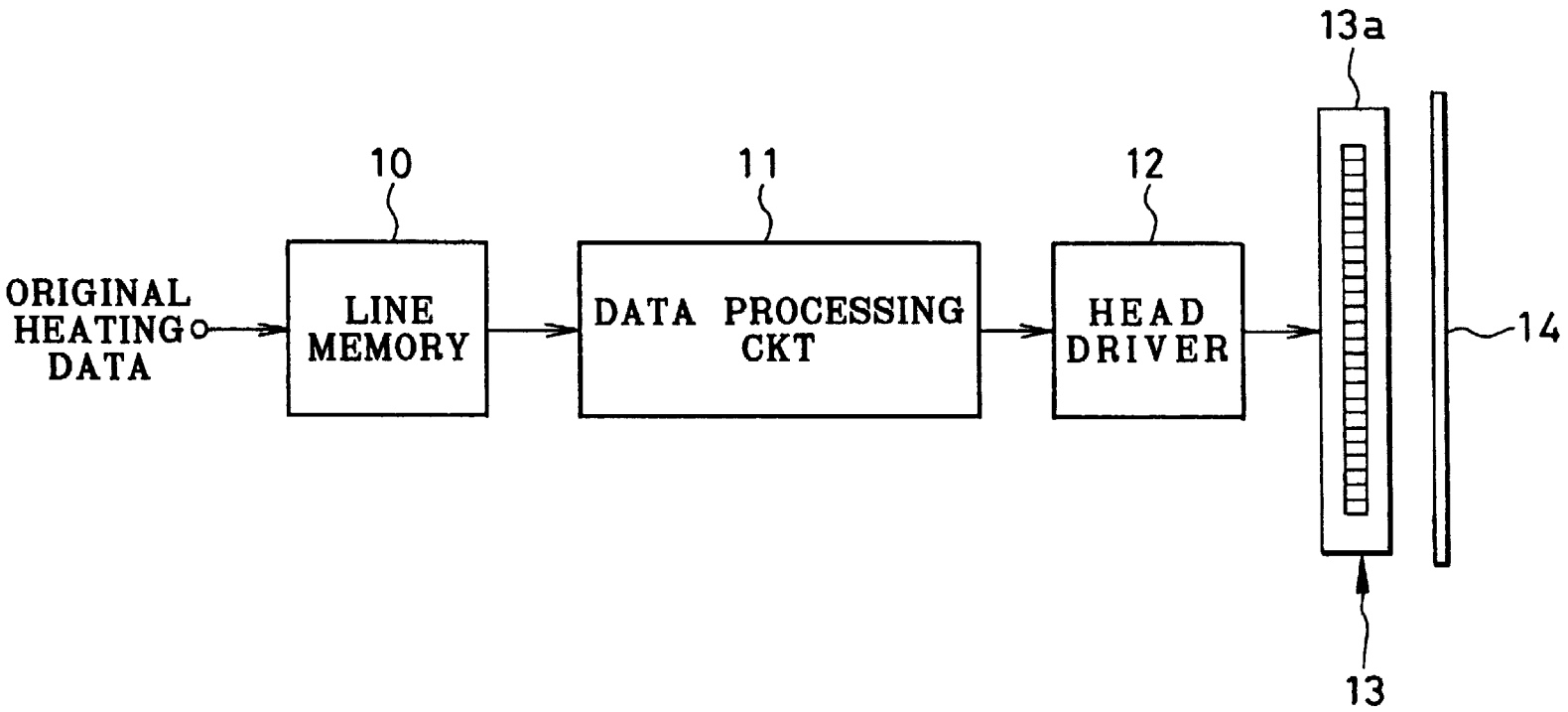
FIG. 1 is a schematic diagram of a thermal printer embodying the present invention.

FIG. 1 shows essential parts of a thermosensitive recording type thermal printer embodying the present invention. Original heating data of one line written in a line memory 10 is sent to a data processing circuit 11 for correcting the original heating data so as to prevent the heat accumulation from affecting density of an image to print. The corrected heating data of one line is sent to a head driver 12. The head driver 12 drives a thermal head 13 while the thermal head 13 is in tight contact with a thermosensitive recording sheet 14. The thermosensitive recording sheet 14 moves in a direction perpendicular to the drawing sheet as viewed in FIG. 1.

Figure 2:
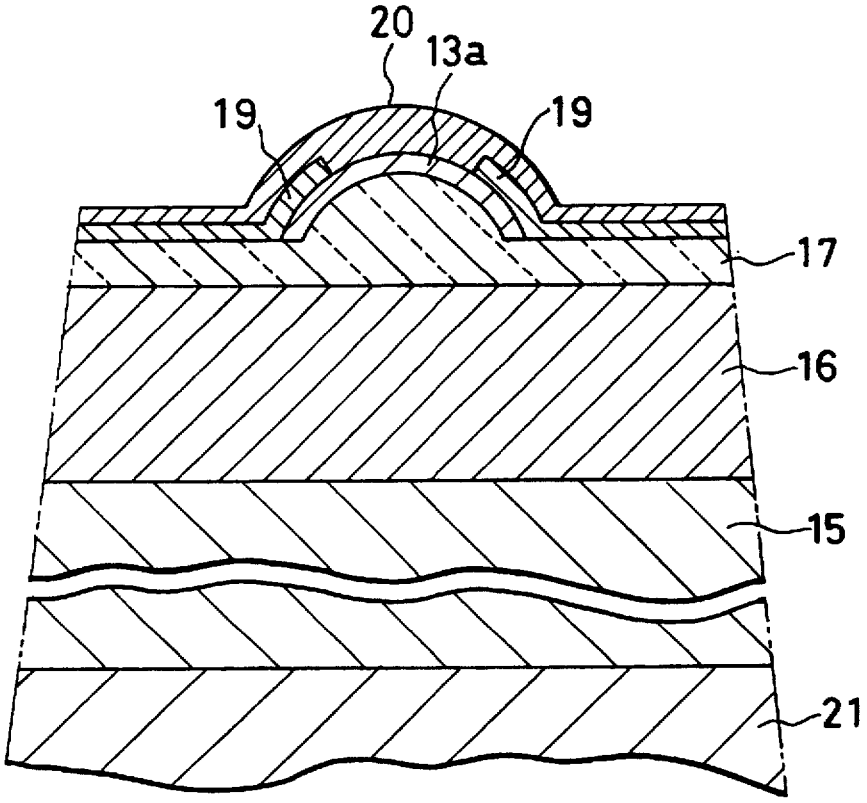
FIG. 2 is an explanatory fragmentary section of a thermal head illustrating layered structure thereof.

As well known, the thermal head 13 has a number of heating elements 13*a* in a line. As shown in FIG. 2, each heating element 13*a* is a resistance heating film which is connected to a pair of electrodes 19. The heating elements 13*a* and the electrodes are disposed on a glazed layer 17 that is formed on one surface of a ceramic substrate 16. The substrate 16 is fixedly mounted on an aluminum plate 15, and a radiation plate 21 is fixedly mounted on the opposite side of the aluminum plate 15. The heating elements 13*a* and the electrodes 19 are covered with a protection layer 20. The glazed layer 17, the ceramic substrate 16, the aluminum plate 15 and the radiation plate 21 constitute heat accumulating layers which accumulate a fraction of heat energy generated from the heating elements 13*a*. The accumulated heat energy have influence on the recording.

In correspondence with the heating data of one pixel, an amount of electric power is supplied to one heating element 13*a*, so the heating element 13*a* generates heat energy whose value corresponds to the heating data. The amount of electric power is changed by adjusting time duration of continuous power supply, or by adjusting the number of times of periodic power supply.

The thermosensitive recording performs bias heating and image or gradation heating to record a dot. The bias heating is to heat the thermosensitive recording sheet 14 up to a degree slightly less than a coloring point of the recording sheet 14 at which color begins to develop. The gradation heating is to heat the thermosensitive recording sheet 14 by a degree that corresponds to a designated coloring density. For the bias heating, all heating elements 13*a* are uniformly heated by bias data. The bias data is basically the same for all heating elements. However, if there is any variance between resistance values of the heating elements 13*a*, the bias data is adjusted to compensate for the variance. The gradation heating is performed in accordance with input image data. Therefore, in the thermosensitive recording, the heating data consists of the bias data and the image data. Since the thermal transfer recording performs only the gradation heating, the heating data corresponds to the image data. In the thermosensitive recording, the image data or the bias data or both may be processed in the data processing circuit 11.

Figure 3:
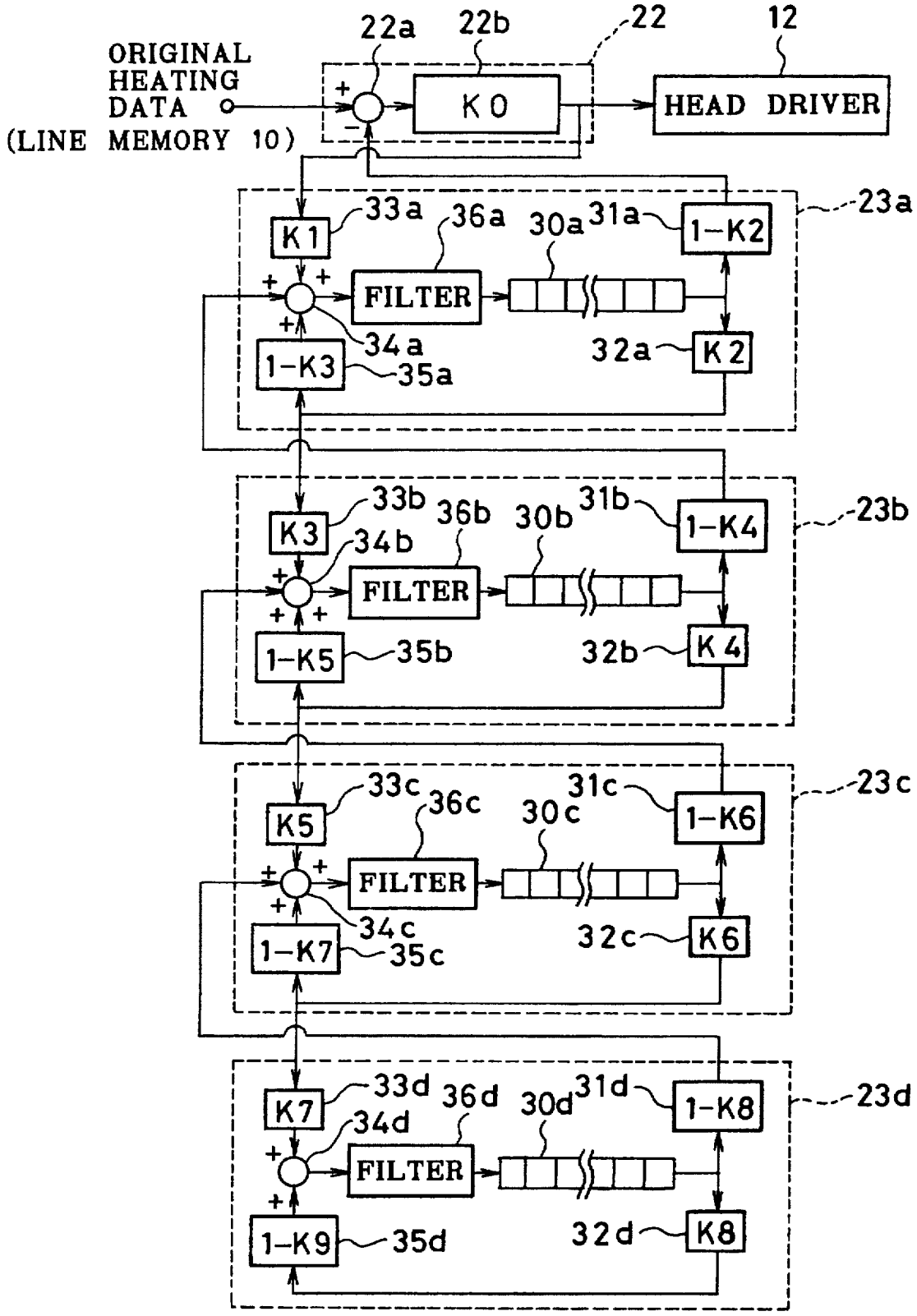
FIG. 3 is a block diagram showing a data processing circuit for correcting heating data according to an embodiment of the present invention.

FIG. 3 shows an embodiment of the data processing circuit 11. The data processing circuit 11 is constituted of a correction circuit 22 and first to fourth operation circuits 23*a*, 23*b*, 23*c* and 23*d*. The first to fourth operation circuits 23*a* to 23*d* are provided for calculating correction data for correcting original heating data with regard to heat accumulation in the glazed layer 17, the substrate 16, the aluminum plate 15 and the radiation plate 21 respectively. Hereinafter, the correction data obtained from the first to fourth operation circuits 23*a* to 23*d* will be referred to as first to fourth correction data respectively.

The correction circuit 22 includes a subtracter 22*a* for subtracting the first correction data from the original heating data, and a multiplier 22*b* for multiplying the heating data after the subtraction by a coefficient "K0", e.g. K0=1/(1−K1). Although heat energy generated from the individual heating element 13*a* is mostly transmitted or transferred to the recording sheet 14, a small fraction of the heat energy is transmitted to the glazed layer 17. The coefficient "K0" is designed to compensate for the fraction of the heat energy that is transmitted not to the recording sheet 14, but to the glazed layer 17.

The first correction data from the first operation circuit 23*a* is to correct the original heating data with regard to the influence of heat energy accumulated in the glazed layer 17 on the individual heating elements 13*a*. When recording an initial line or the first line in the order of recording an image, the original heating data of the first line is sent in serial from the line memory 10 to the subtracter 22*a*. Since heat accumulation in the glazed layer 17 is ideally zero at the start of recording the first line, the first correction data is zero. Thus, the original heating data is multiplied by the coefficient "K0" to produce corrected heating data. The corrected heating data is sent from the correction circuit 22 to the head driver 12 and to the first operation circuit 23*a*. Based on the corrected heating data of one line and other data relating to heat accumulation in the glazed layer 17, the first operation circuit 23a calculates the first correction data for the next line.

Specifically, the first operation circuit 23a has a register 30a which stores first heat accumulation data that represents the thermal history of the glazed layer 17, i.e. condition of heat energy accumulated in the glazed layer 17 before the start of recording a line, hereinafter called line #M, i.e. by the end of recording the preceding line #M−1. The register 30a is a shift register having memory cells corresponding in number and arrangement to the heating elements 13a of the thermal head 13, and thus to pixels constituting one line. The first heat accumulation data for one pixel or relating to one heating element 13a, as written in each memory cell of the register 30a, represents a heat accumulation in the glazed layer 17 that has effect on the corresponding heating element 13a.

The first heat accumulation data for one line stored in the register 30a is sent in serial to multipliers 31a and 32a. The multiplier 31a seriatim multiplies the first heat accumulation data by a coefficient "1−K2", to provide the first correction data. The coefficient "1−K2" corresponds to a fraction of the accumulated heat energy that is transmitted from the glazed layer 17 to the heating elements 13a. Accordingly, the first correction data for one pixel represents a heat energy value that is transmitted from the glazed layer 17 to the corresponding heating element 13a, and is added to the heat energy newly generated from the corresponding heating element 13a. The first correction data is sent in serial to the subtracter 22a of the correction circuit 22.

To the subtracter 22a, original heating data of the line #M is sent in serial from the line memory 10 in the same sequence and at the same timing as the first correction data. Thus, the first correction data for one pixel is subtracted from the original heating data for the corresponding pixel. Thereafter, the heating data after the subtraction is multiplied by the coefficient "K0". The corrected heating data of the line #M is sent to the head driver 12, and also to a multiplier 33a. The multiplier 33a multiplies the corrected heating data by a coefficient K1. The coefficient K1 corresponds to the fraction of heat energy that is transmitted from the heating elements 13a to the glazed layer 17a. Accordingly, the output data of the multiplier 33a obtained for each pixel from the corrected heating data of the line #M represents a heat energy value that is transmitted from the corresponding heating element 13a to the glazed layer 17, and is newly accumulated therein at the end of recording the line #M. The output data of the multiplier 33a is sent in serial to an adder 34a.

The other multiplier 32a multiplies the first heat accumulation data by a coefficient "K2" to convert it into data representative of a fraction of heat energy that has been accumulated in the glazed layer 17 due to the past heating and is not transmitted to the heating elements 13a. The output data of the multiplier 32a is sent to a multiplier 35a and the second operation circuit 23b. The multiplier 35a multiplies the output data of the multiplier 32a by a coefficient "1−K3" to convert it into data representative of a fraction of heat energy that stays accumulated in the glazed layer 17. In other words, a coefficient "K3" corresponds a fraction of heat energy that is transmitted from the glaze layer 17 further to the substrate 16. Therefore, the output data of the multiplier 35a thus obtained for each pixel from the first heat accumulation data represents a heat energy value that has been accumulated due to the past heating of the corresponding heating element 13a and stays accumulated to the end of recording the line #M in an individual portion of the glazed layer 17 that is disposed under the corresponding heating element 13a. The output data of the multiplier 35a is sent in serial to the adder 34a in the same sequence as the output data of the multiplier 33a.

At the adder 34a, the output data of the multiplier 33a for one pixel, and the output data of the multiplier 35a for the corresponding pixel, and also the second correction data for the corresponding pixel are added. The second correction data is sent from the second operation circuit 23b and represents for each pixel a heat energy value that is transmitted from the substrate 16 to the individual portion of the glazed layer 17 under the corresponding heating element 13a. The sum thus obtained for each pixel at the adder 34a is sent to a filter 36a. Hereinafter the sum obtained for each pixel at the adder 34a will be called an individual heat accumulation value, which represents a heat energy value accumulated in the individual portion of the glazed layer 17 at the end of recording the line #M. The filter 36a processes the individual heat accumulation value through a filtering operation as set forth in detail below, to convert each individual heat accumulation value into an effective heat accumulation value for each pixel, taking the effect of heat accumulation in the adjacent portions as well as in the individual portion of the glazed layer 17 into consideration. The effective heat accumulation values obtained by the filter 36a are sent in serial to the register 30a, and are sequentially overwritten therein as a new series of first heat accumulation data.

In recording the next line #M+1, the first heat accumulation data stored in the register 30a in the end of recording the line #M is sent in serial to the multipliers 31a and 32a. The multiplier 31a seriatim multiplies the first heat accumulation data by the coefficient "1−K2", to provide the first correction data for the line #M+1. The first correction data is sent in serial to the subtracter 22a of the correction circuit 22. To the subtracter 22a, original heating data of the line #M+1 is sent in serial from the line memory 10 in the same sequence and at the same timing as the first correction data. Thus, the first correction data for one pixel of the line #M+1 is subtracted from the original heating data for the corresponding pixel of the line #M+1.

Thereafter, the heating data after the subtraction is multiplied by the coefficient "K0". The corrected heating data of the line #M+1 is sent to the head driver 12, and also to the multiplier 33a. In the same way as above, the first heat accumulation data in the register 30a is revised in the end of recording the line #M+1.

Figure 4:
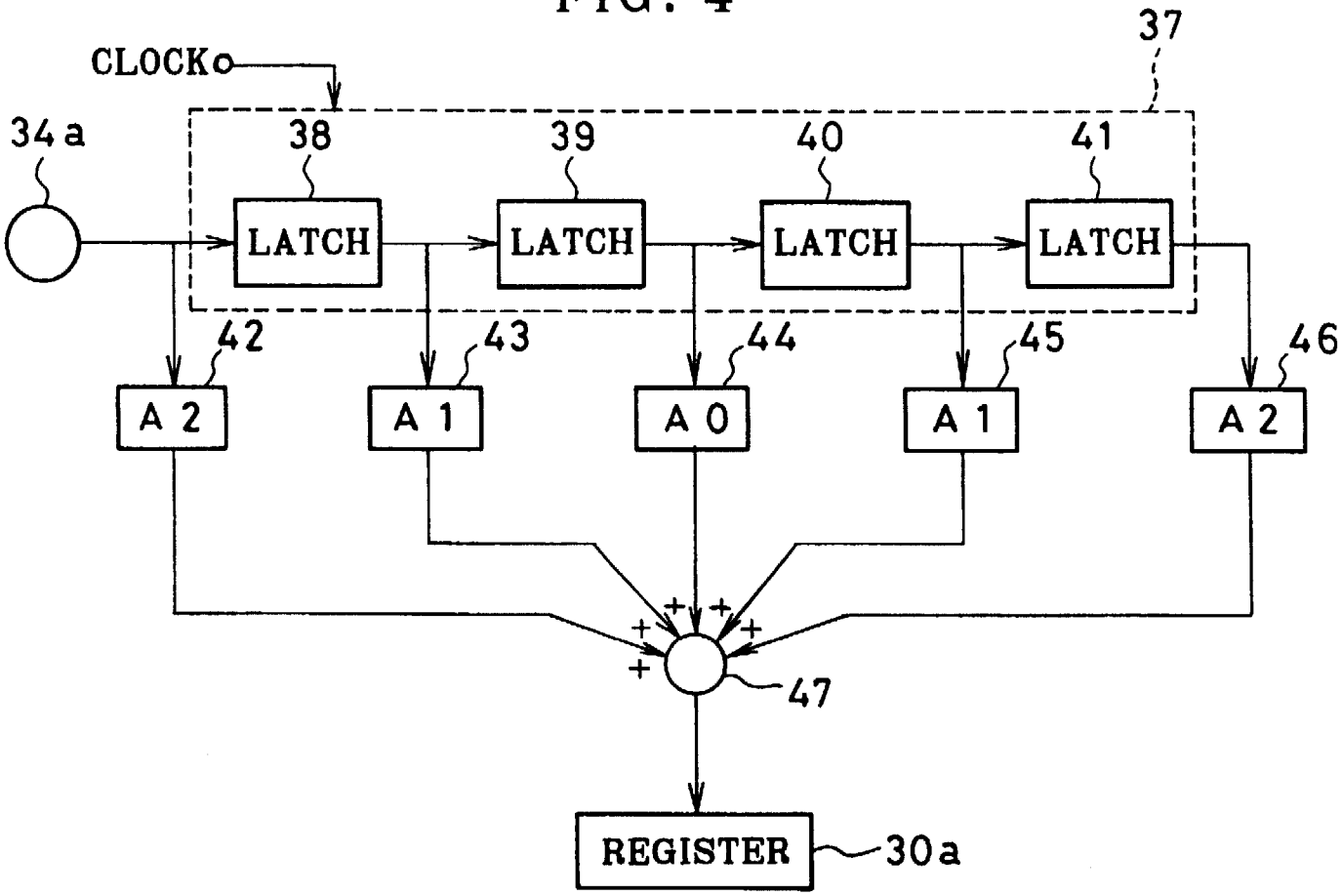
FIG. 4 is a block diagram showing a filter included in the data processing circuit.

FIG. 4 shows an example of the filter 36a. The filter 36a has a shift register 37 which is constituted of four cascade-connected latch circuits 38, 39, 40 and 41. The output data of the adder 34a or individual heat accumulation values obtained during the recording of the line #M are sent in serial to the shift register 37, and shifted to the next latch circuit in response to a clock. The input and output terminals of the latch circuit 38 are connected to multipliers 42 and 43 respectively. The input and output terminals of the latch circuit 41 are connected to multipliers 45 and 46. The output terminal of the latch circuit 39 is connected to a multiplier 44.

The multipliers 42 and 46 multiply the individual heat accumulation values received therein by a coefficient "A2". The multipliers 43 and 45 multiply the individual heat accumulation values respectively received therein by a coefficient "A1". The multiplier 44 multiplies the individual heat accumulation value received therein by a coefficient "A0". The products, i.e. multiplication results from these multipliers 42 to 46 are added at an adder 47. The sum obtained at the adder 47 is sent to the register 47, to be written as first heat accumulation data for a subject pixel. In this case, the subject pixel is a pixel that is assigned to the individual heat accumulation value latched by the latch circuit 39.

As described above, the first heat accumulation data for one line and the heating data of one line are read respectively from the register 30*a* and the line memory 10 in the same sequence, that is, in order from one end to the other end of each line. Accordingly, an individual heat accumulation value for a first pixel that is disposed at the first position of the line in this order, is first sent from the adder 34*a* to the shift register 37, and is latched by the latch circuit 38 in response to a clock. Next, an individual heat accumulation value for a second pixel disposed at the second position of the line in the order, is sent to the shift register 37. In response to a second clock, the individual heat accumulation value for the first pixel is shifted to and latched by the latch circuit 39, and the individual heat accumulation value for the second pixel is latched by the latch circuit 38.

The filtering process starts when the shift register 37 latches the individual heat accumulation values for the first and second pixels and receives an individual heat accumulation value for a third pixel that is disposed at the third position of the line. The individual heat accumulation value for the first pixel is multiplied by the coefficient "A0" at the multiplier 44 and then sent to the adder 47. The individual heat accumulation value for the second pixel is multiplied by the coefficient "A1" at the multiplier 43 and then sent to the adder 47. The individual heat accumulation value for the third pixel is multiplied by the coefficient "A2" at the multiplier 42 and then sent to the adder 47. The sum obtained at the adder 47 constitutes an effective heat accumulation value in the glazed layer 16 relating to the first pixel, and is sent to the register 30*a*, to be written as the first heat accumulation data for the first pixel.

In this way, the individual heat accumulation value for the first pixel is not directly used as the first heat accumulation data for the first pixel, but the individual heat accumulation values for the two adjacent pixels are added to the individual heat accumulation value for the first pixel after these values are respectively multiplied by the coefficients A0, A1 and A2, which are predetermined according to the relative position to the subject pixel, i.e. the first pixel in this instance. Consequently, in addition to the individual heat accumulation value in a portion of the glazed layer 17 under a first heating element assigned to the first pixel, the individual heat accumulation values in those portions of the glazed layer 17 under second and third heating elements assigned to the second and third pixels are taken into consideration for correction the heating data for the first pixel. It is to be noted that the sum A0+A1+A2 of the coefficients A0, A1 and A2 is determined to be "1" in decimal notion.

When an individual heat accumulation value for a fourth pixel is received by the shift register 37, the individual heat accumulation values for the first to third pixels are latched in the latch circuits 40, 39 and 38 respectively. Then, the individual heat accumulation value for the second pixel is multiplied by the coefficient A0 at the multiplier 44, the individual heat accumulation value for the third pixel is multiplied by the coefficient A1 at the multiplier 43, and the individual heat accumulation value for the fourth pixel is multiplied by the coefficient A2 at the multiplier 42. Also, the individual heat accumulation value for the first pixel is multiplied by the coefficient Al at the multiplier 45.

The four products from the multipliers 42 to 45 are added at the adder 47, to provide an effective heat accumulation value in the glazed layer 17 relating to the second pixel. Accordingly, the individual heat accumulation value for the second pixel is processed by use of the individual heat accumulation values for the adjacent first, third and fourth pixels.

When an individual heat accumulation value for a fifth pixel is received by the shift register 37, the individual heat accumulation values for the first to fourth pixels are latched in the latch circuits 41, 40, 39 and 38 respectively. Then, the individual heat accumulation value for the third pixel is multiplied by the coefficient A0 at the multiplier 44, the individual heat accumulation values for the first and fifth pixels are multiplied by the coefficient A2 at the multiplier 46 and 42 respectively, and the individual heat accumulation values for the second and fourth pixels are multiplied by the coefficient Al at the multipliers 45 and 43 respectively.

The five products from the multipliers 42 to 46 are added at the adder 47, to provide an effective heat accumulation value in the glazed layer 17 relating to the third pixel. Accordingly, the individual heat accumulation value for the second pixel is processed by use of the individual heat accumulation values for the adjacent four pixels, two of which are disposed on either side of the third pixel in the same line.

In the same way as for the third pixel, the individual heat accumulation value for the fourth and those for the following pixels are each individually processed or converted into an effective heating accumulation value by use of individual heat accumulation values for the adjacent four pixels, two of which are disposed on either side of the subject pixel in the same line. When an individual heat accumulation value for a last pixel in the order of data reading is latched by the latch circuit 39, and is converted into an effective heat accumulation value for the last pixel through the filtering, a new series of first heat accumulation data, i.e. the first heat accumulation data obtained during the recording of the line #M in this instance, has been written in the register 30*a*.

In practice, two pieces of dummy data having a value "0" in decimal notion are added to either end of a series of heating data of each line. Because the dummy data is also processed in the same way as the heating data, the filtering operation is performed for any subject pixel by use of five individual heat accumulation values including that for the subject pixel, even for the first two pixels and the last two pixels of one line in the order of serial reading of the heating data. Needless to say, the dummy data has no effect on the actual printing.

As shown in FIG. 3, the second to fourth operation circuits 23*b* to 23*d* have the same construction as the first operation circuit 23*a*. The second operation circuit 23*b* is constituted of a register 30*b*, multipliers 31*b*, 32*b* and 33*b* and 35*b*, an adder 34*b*, and a filter 36*b*. The third operation circuit 23*c* is constituted of a register 30*c*, multipliers 31*c*, 32*c* and 33*c* and 35*c*, an adder 34*c*, and a filter 36*c*. The fourth operation circuit 23*d* is constituted of a register 30*d*, multipliers 31*d*, 32*d* and 33*d* and 35*d*, an adder 34*d*, and a filter 36*d*.

The second operation circuit 23*b* calculates the second correction data based on second heat accumulation data stored in the register 30*b*, that represents the thermal history of the substrate 16. The register 30*b* has memory cells corresponding in number and arrangement to the heating elements 13*a*. The second heat accumulation data written in each memory cell of the register 30*b* represents an effective heat accumulation value in the substrate 16 that has effect on the corresponding heating element 13*a*.

The third operation circuit 23c calculates the third correction data based on third heat accumulation data stored in the register 30c, that represents the thermal history of the aluminum plate 15. The register 30c has memory cells corresponding in number and arrangement the heating elements 13a. The third heat accumulation data written in each memory cell of the register 30c represents an effective heat accumulation value in the aluminum plate 15 that has effect on the corresponding heating element 13a.

The fourth operation circuit 23d calculates the fourth correction data based on fourth heat accumulation data stored in the register 30d, that represents the thermal history of the radiation plate 21. The register 30d has memory cells corresponding in number and sequence to the array of heating elements 13a. The fourth heat accumulation data written in each memory cell of the register 30d represents an effective heat accumulation value in the radiation plate 21 that has effect on the corresponding heating element 13a.

The multipliers 31b to 33b and 35b of the second operation circuit 23b are allotted coefficients "1–K4","K4", "K3" and "1–K5" respectively. The multipliers 31c to 33c and 35c of the third operation circuit 23c are allotted coefficients "1–K6", "K6", "K5" and "1–K7" respectively. The multipliers 31d to 33d and 35d of the fourth operation circuit 23d are allotted coefficients "1–K8", "K8", "K7" and "1–K9" respectively.

The value K1 is determined in accordance with the shape of the thermal head 13, the material properties of the recording sheet 14, the rate of heat transfer or transmission from the heating element 13a to the glazed layer 17, and other factors. The value K2 is determined in accordance with the material properties of the glazed layer 17 and other factors. The value K3 is determined in accordance with the rate of heat transfer or transmission from the glazed layer 17 to the ceramic substrate 16 and other factors.

The coefficient K1 approaches to "1", as the heat transfer rate from the heating element 13a to the glazed layer 17 increases. The coefficient K2 approaches to "1" and the coefficient "1–K2" approaches to zero, as the heat transfer rate from the glazed layer 17 to the substrate 16 increases, and as the heat transfer rate from the glazed layer 17 to the heating element 13a decreases. The coefficient K3 approaches to "1" and the coefficient "1–K3" approaches to zero, as the heat transfer rate from the substrate 16 to the aluminum plate 15 increases, and as the heat transfer rate from the substrate 16 to the glazed layer 17 decreases. In the same way, the values of other coefficients K4 to K9 are determined in accordance with the respective material qualities of the substrate 16, the aluminum plate 15 and the radiation plate 21, and the rate of heat transfer between these layers.

For the thermosensitive recording, since the necessary heat energy varies depending upon the color to record in the color thermosensitive recording sheet, the values K1 to K9 also vary depending upon the color. To yellow recording, for example, K1=0.15, K2=0.91, K3=0.67, and K4=0.98. To magenta recording, K1=0.19, K2=0.91, K3=0.59, and K4=0.985. To cyan recording, K1=0.27, K2=0.87, K3=0.51, and K4=0.9832.

Now the overall operation of the data processing circuit 11 as shown in FIG. 3 will be described. When recording the line #M, the heating data of the line #M is sent from the line memory 10 to the correction circuit 22. Simultaneously, the first heat accumulation data stored in the register 30a of the first operation circuit 23a, which is derived from the heating data of the heating data of the preceding line #M−1 during the recording of the preceding line #M−1, is sequentially read and is converted into the first correction data by being multiplied by the coefficient "1–K2". Hereinafter, the first heat accumulation data obtained based on the heating data of the line #M−1 will be referred to as the first heat accumulation data of the line #M. The first correction data for one pixel is subtracted from the heating data for the corresponding pixel of the line #M at the subtracter 22a. The subtraction results are each multiplied by the coefficient "K0" at the multiplier 22b. The heating data thus corrected is sent to the head driver 12, which then drives the heating elements 13a to record the line #M in correspondence with the heating data of the line #M.

The corrected heating data of the line #M is also multiplied by the coefficient "K1" at the multiplier 33a of the first operation circuit 23a, to be converted into data representative of heat energy transmitted from the heating elements 13a to the glazed layer 17 during the recording of the line #M.

On the other hand, the first heat accumulation data is also multiplied by the coefficient "K2" at the multiplier 32a. The output of the multiplier 32a is multiplied by the coefficient "1–K3" at the multiplier 35a, to be converted into data representative of heat energy that has been accumulated in the glazed layer 17 due to the past heating and stays accumulated therein to the end of recording the line #M. The output of the multiplier 32a is also sent to the multiplier 33b of the second operation circuit 23b.

By multiplying the coefficient "K3" at the multiplier 33b, the data is converted into data representative of heat energy that is transmitted from the glazed layer 17 to the substrate 16 during the recording of the line #M. Simultaneously, the second heat accumulation data stored in the register 30b of the second operation circuit 23b is sequentially read and is converted into the second correction data by being multiplied by the coefficient "1–K4". The second correction data is sent to the adder 34a of the first operation circuit 23a. The second correction data for one pixel represents a heat energy value that has been accumulated due to the past heating and is transmitted from the substrate 16 to the glazed layer 17 under the corresponding heating element 13a during the recording of the line #M.

Simultaneously, the second heat accumulation data is multiplied by the coefficient "K4" at the multiplier 32b, to be converted into data representative of heat energy that has been accumulated in the substrate 16 due to the past heating, and is not transmitted to the glazed layer 17. The output of the multiplier 32b is multiplied by the coefficient "1–K5" at the multiplier 35b, to be converted into data representative of heat energy that has been accumulated due to the past heating and stays accumulated in the substrate 16 to the end of recording the line #M. The output of the multiplier 32b is also sent to the multiplier 33c of the third operation circuit 23c.

In the same way as the second operation circuit 23b, the third operation circuit 23c multiplies the data by the coefficient "K5" at the multiplier 33c, to obtain data representative of heat energy transmitted from the substrate 16 to the aluminum plate 15. Simultaneously, the third heat accumulation data stored in the register 30c of the third operation circuit 23c is sequentially read and is converted into the third correction data by being multiplied by the coefficient "1–K6". The third correction data is sent to the adder 34b of the second operation circuit 23b.

The third correction data for one pixel represents a heat energy value that has been accumulated due to the past heating and is transmitted from the aluminum plate 15 to an individual portion of the substrate 16 under the corresponding heating element 13*a*. Simultaneously, the third heat accumulation data is multiplied by the coefficient "K6" at the multiplier 32*c*, and then by the coefficient "1−K7" at the multiplier 35*c*, to be converted into data representative of heat energy that has been accumulated in the aluminum plate 15 due to the past heating and stays accumulated to the end of recording the line #M. The output of the multiplier 32*c* is also sent to the multiplier 33*d* of the fourth operation circuit 23*d*.

By multiplying the coefficient "K7" at the multiplier 33*d*, the data is converted into data representative of heat energy transmitted from the aluminum plate 15 to the radiation plate 21. Simultaneously, the fourth heat accumulation data stored in the register 30*d* of the fourth operation circuit 23*d* is sequentially read and is converted into the fourth correction data by being multiplied by the coefficient "1−K8". The fourth correction data is sent to the adder 34*c* of the third operation circuit 23*c*. The fourth correction data for one pixel represents a heat energy value that has been accumulated due to the past heating and is transmitted from the radiation plate 21 to the aluminum plate 15 under the corresponding heating element 13*a*. Simultaneously, the fourth heat accumulation data is multiplied by the coefficient "K8" at the multiplier 32*d*, and then by the coefficient "1−K9" at the multiplier 35*d*.

In the first operation circuit 23*a*, the output of the multiplier 33*a*, the output of the multiplier 35*a*, and the second correction data from the second operation circuit 23*b* are added at the adder 34*a*. The output of the adder 34*a* is processed by the filter 36*a* in the way as set forth above. In this way, a new series of first heat accumulation data is obtained during the recording of the line #M based on the heating data of the line #M, the previously stored first heat accumulation data of the line #M−1, and the second correction data. The new series of first heat accumulation data sequentially takes the place of the first heat accumulation data of the line #M−1 in the register 30*a*.

In the second operation circuit 23*b*, the output of the multiplier 33*b*, the output of the multiplier 35*b*, and the third correction data from the third operation circuit 23*c* are added at the adder 33*b*. The output of the adder 34*b* is processed by the filter 36*b* in the same way as described with respect to the filter 36*a*, so as to take not only an individual heat accumulation in a portion of the substrate 16 that is disposed under each individual heating element 13*a*, but also the influence of heat accumulation in adjacent portions of the substrate 16 into consideration. In this way, a new series of second heat accumulation data is obtained during the recording of the line #M, based on the first heat accumulation data of the line #M−1, the previously stored second heat accumulation data, and the third correction data.

In the same way, the content of the register 30*c* is revised by a new series of third heat accumulation data that is obtained based on the previously stored second heat accumulation data, the previously stored third heat accumulation data, and the fourth correction data. The content of the register 30*d* is revised by a new series of fourth heat accumulation data that is obtained based on the previously stored third heat accumulation data, and the previously stored fourth heat accumulation data.

When recording the next line #M+1, the first to fourth correction data is calculated based on the first to fourth heat accumulation data newly written in the register 30*a* to 30*d* during the recording of the line #M, in the same way as set forth above.

As described so far, not only thermal histories of the respective heating elements 13*a*, but also thermal histories of all the heat accumulating layers 17, 16, 15 and 21, i.e. heat accumulation in the respective layers and heat transmission between these layers, are considered in generating the first correction data. Consequently, the influence of heat accumulation on the individual heating element 13*a* is estimated with accuracy, so the heating data is corrected precisely. In addition, the heat accumulation data of each heat accumulating layer is obtained by filtering an individual heat accumulation value relating to the individual heating element 13*a* based on those individual heat accumulation values relating to the adjacent heating elements 13*a*, in each of the filters 36*a* to 36*d*. Therefore, the heating data for the individual heating element 13*a* is corrected while taking account of the influence of heat accumulations in those portions of the respective heat accumulating layers which relate to the adjacent heating elements 13*a*.

The construction of the data processing circuit 11 for correcting the heating data to eliminate the influence of heat accumulation in the thermal head 13 is not limited to the above embodiment, but can be modified in the way as set forth below. Any of the following embodiments can achieve a high correction accuracy that is comparable to the above embodiment.

Figure 5:
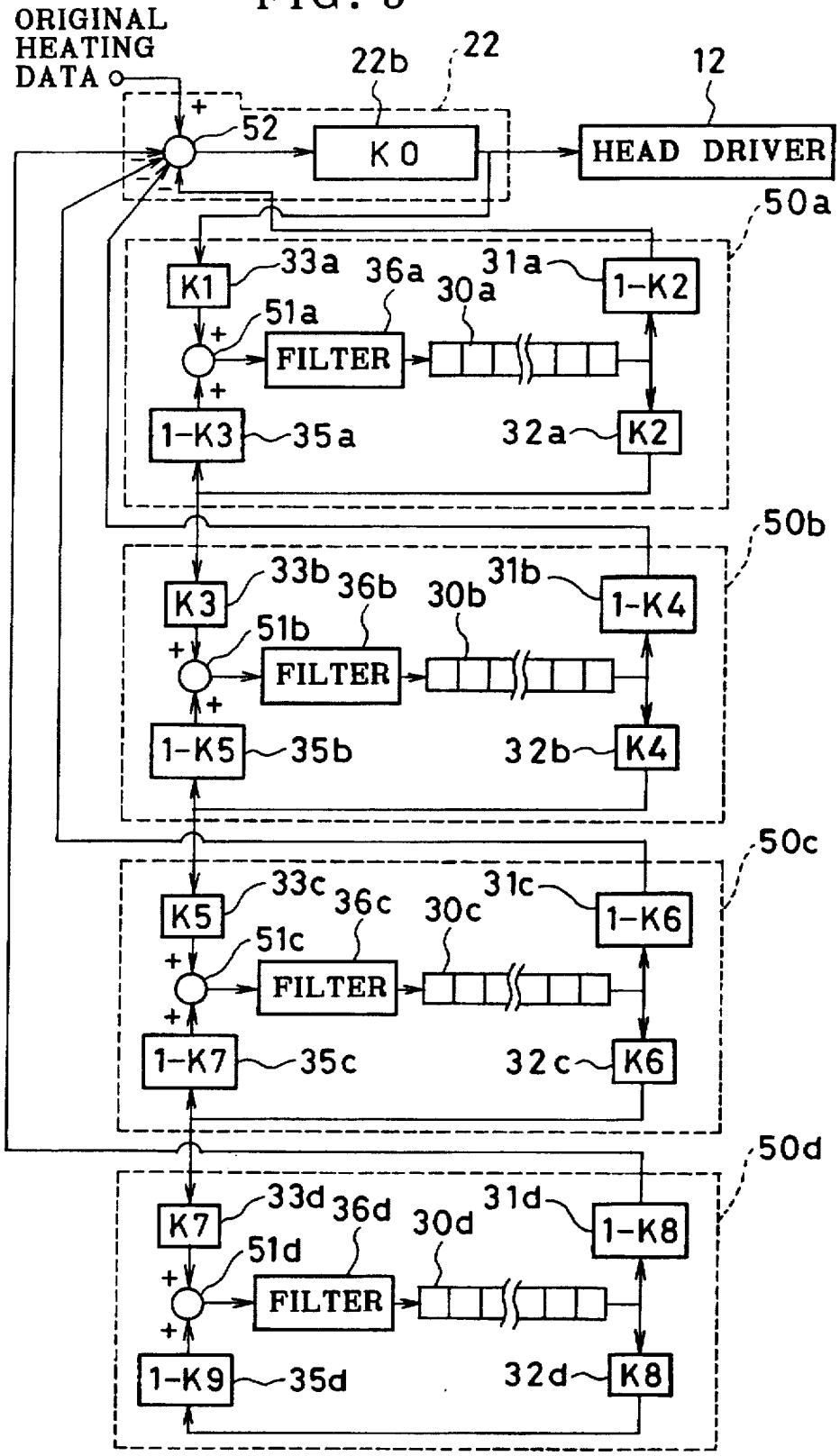
FIG. 5 is a block diagram showing a data processing circuit according to a second embodiment of the present invention.

In the embodiment shown in FIG. 5, first to fourth operation circuits 50*a* to 50*d* are provided for calculating first to fourth heat accumulation data relating to the glazed layer 17, the substrate 16, the aluminum plate 15 and the radiation plate 21 respectively, and for calculating based on the first to fourth heat accumulation data first to fourth correction data for correcting original heating data of the next line in the approximately same way as in the embodiment of FIG. 3. The first to fourth correction data calculated for each pixel is sent directly to a subtracter 52 of a correction circuit 22, to be subtracted from original heating data of a corresponding pixel, instead of being sent to subtracters 51*a* to 51*d* provided respectively in the first to fourth operation circuits 50*a* to 50*d*.

Figure 6:
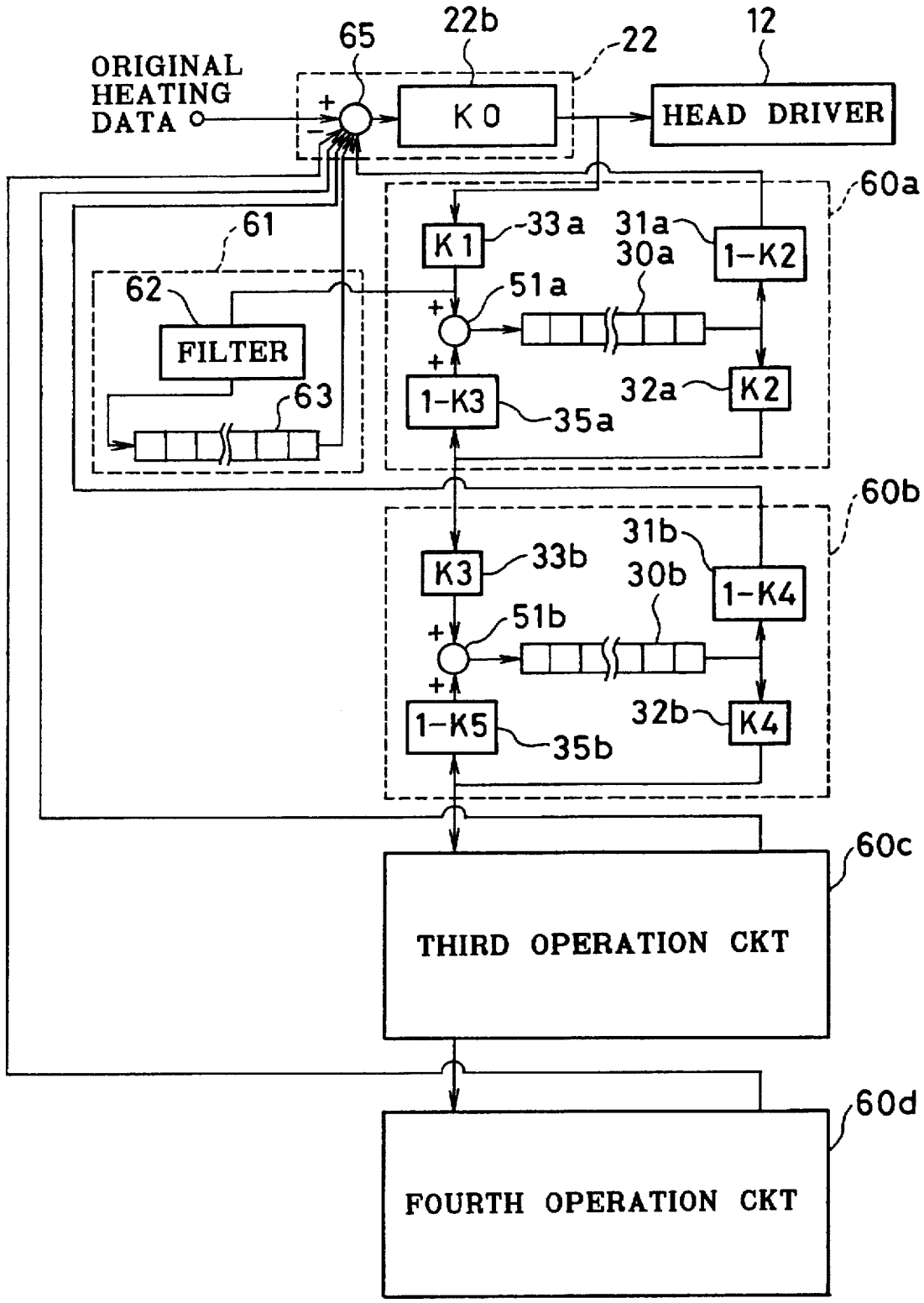
FIG. 6 is a block diagram showing a data processing circuit according to a third embodiment of the present invention.

In the embodiment shown in FIG. 6, first to fourth operation circuits 60*a* to 60*d* are provided for calculating first to fourth heat accumulation data relating to the glazed layer 17, the substrate 16, the aluminum plate 15 and the radiation plate 21 respectively. The first to fourth operation circuits 60*a* to 60*d* has no filter, but a filter circuit 61 having a filter 62 and a shift register 63 is provided in connection with the first operation circuit 60*a*. The filter 62 receives output data of a multiplier 33*a* in serial, each data piece represents a heat energy value generated by a heating of a heating element 13*a* and is transmitted from a heating element 13*a* to the glazed layer 17. The filter 62 derives sub-correction data for correcting the heating data of each pixel with regard to the influence of heat accumulation in those portions of the glazed layer 17 which are disposed under the adjacent heating elements 13*a*. The sub-correction data for one line derived from the output data of the multiplier 33*a* for one line is written in the register 63. The sub-correction data for one line is sent in serial to a subtracter 65 of a correction circuit 22 during the recording of the next line, concurrently with first to fourth correction data from the first to fourth operation circuit 60*a* to 60*d*, calculated based on the first to fourth heat accumulation data obtained during the recording of the preceding line. The first and fourth operation circuit 60*c* and 60*d* have the same construction as the second operation circuit 60*b*, though multiplication coefficients are different from each other.

Figure 7:
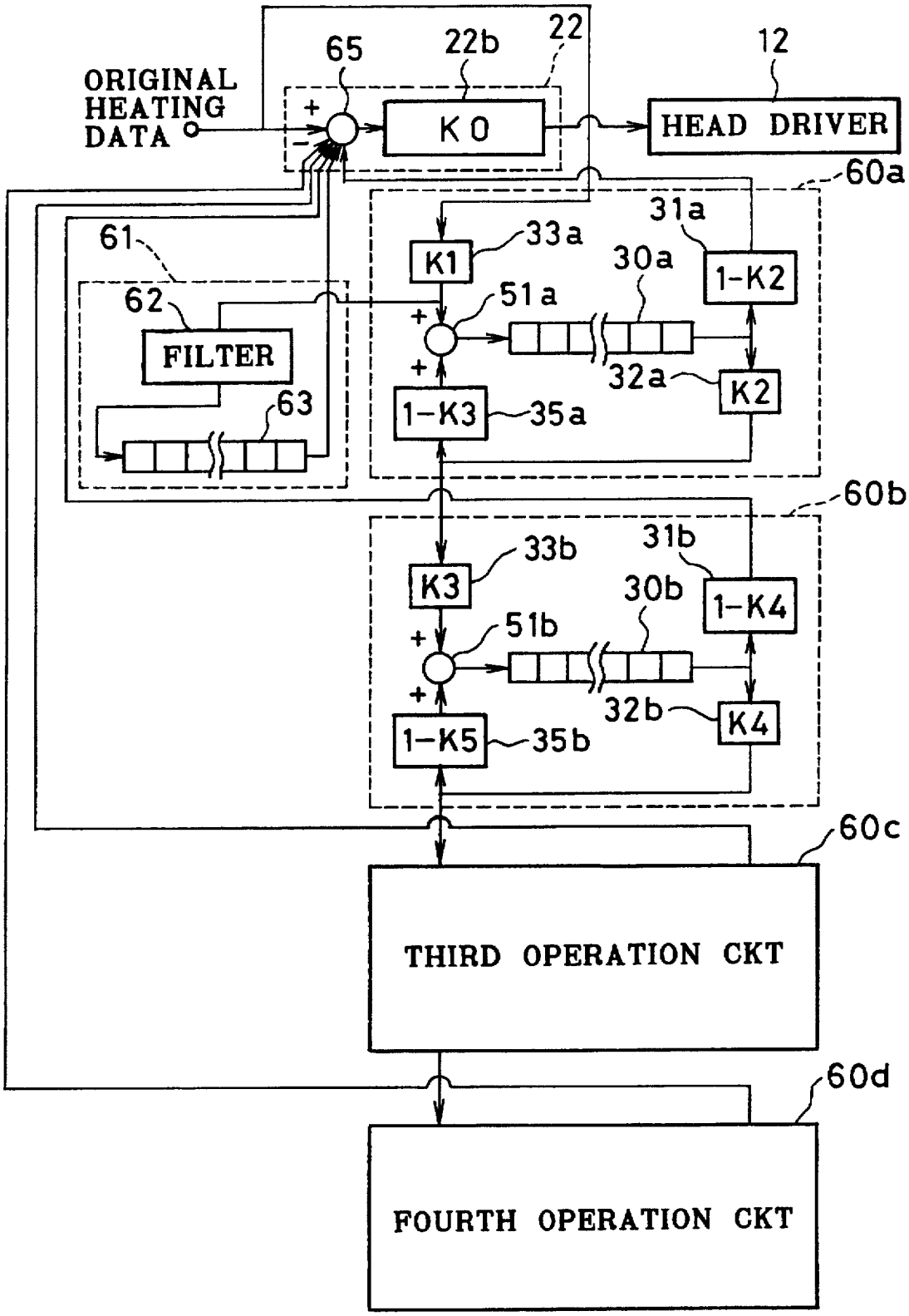
FIG. 7 is a block diagram showing a data processing circuit according to a fourth embodiment of the present invention.

In any of the above embodiments, it is possible to input original heating data to the first operation circuit 23*a*, 50*a*, or 60*a*, instead of corrected heating data, as is shown for example in FIG. 7. It is also possible to omit the multiplier 22*b* from the correction circuit 22 in any of the above embodiments. Moreover, it is possible to omit the filters 36*a* to 36*d* from the operation circuits 23*a* to 23*d*. It is possible to provide the filter circuit 61 in connection to the operation circuit 23*a* after omitting the filters 36*a* to 36*d*.

Although the present invention has been described with respect to the thermosensitive recording type thermal printing, the present invention is applicable to the ink transfer type thermal printing in the same way. Besides the line printer as above, the present invention is applicable to a serial printer where the thermal head moves in a first direction while the recording sheet moves in a second direction perpendicular to the first direction. Although the above embodiments have four operation circuits in correspondence with four heat accumulating layers of the thermal head, the number of operation circuits is variable depending upon the number of heat accumulating layers. Furthermore, the operation circuits can be a CPU.

Thus, the present invention should not be limited to the above described embodiments but, on the contrary, various modification may be possible to those skilled in the art without departing from the scope of claims attached hereto.

What is claimed is:

1. A data processing method for correcting heating data for a thermal head to eliminate influence of heat accumulation in the thermal head on recording density, the thermal head having an array of heating elements arranged in a line and first to Nth heat accumulating layers disposed under the heating elements in this order from the side of heating elements, the heating elements being driven by corrected heating data to print one line after another on a recording sheet, one pixel of each line being assigned to one heating element of the array in regular sequence, the method comprising the steps of:

A. obtaining first to Nth correction data for a subject line to print, from first to Nth heat accumulation data respectively, said first to Nth heat accumulation data being previously stored and representative of respective thermal histories of said first to Nth heat accumulating layers relating to each heating element of the array;

B. correcting original heating data of said subject line, with said first correction data in pixel-to-pixel correspondence, to obtain corrected heating data of said subject line;

C. preparing a new series of first heat accumulation data based on said original or said corrected heating data of said subject line, said previously stored first heat accumulation data, and on said second correction data obtained from said previously stored second heat accumulation data in step A;

D. storing said new series of first heat accumulation data in place of said previously stored first heat accumulation data, during the recording of said subject line;

E. preparing a new series of N-th heat accumulation data, J being 2 to N−1, based on said previously stored (J−1)th heat accumulation data, said previously stored Jth heat accumulation data, and on said (J+1)th correction data obtained from said previously stored (J+1)th heat accumulation data in step A;

F. storing said new series of Jth heat accumulation data in place of said previously stored Jth heat accumulation data, during the recording of said subject line;

G. preparing a new series of Nth heat accumulation data based on said previously stored (N−1)th heat accumulation data, and on said previously stored Nth heat accumulation data;

H. storing said new series of Nth heat accumulation data in place of said previously stored Nth heat accumulation data, during the recording of said subject line;

I. obtaining new series of first to Nth correction data for a next line to print, from said newly stored first to Nth heat accumulation data respectively; and J. repeating the above steps for each line to print.

2. The data processing method as claimed in claim 1, wherein step A comprises the steps of:

multiplying said previously stored first heat accumulation data by a first coefficient to provide said first correction data, said first coefficient being determined by heat transmission properties from said first heat accumulating layer to the heating elements; and multiplying said previously stored second to Nth heat accumulation data by second to Nth coefficients to provide said second to Nth correction data respectively, each of said second to Nth coefficients being determined by heat transmission properties between said second to Nth heat accumulating layers.

3. The data processing method as claimed in claim 1, wherein step B comprises the steps of:

subtracting said first correction data from said original heating data of said subject line in pixel-to-pixel correspondence; and serving subtraction results for one line as said corrected heating data of said subject line.

4. The data processing method as claimed in claim 1, wherein step B comprises the steps of:

subtracting said first correction data from said original heating data of said subject line in pixel-to-pixel correspondence; and multiplying subtraction results for one line by a coefficient determined by heat transmission properties from the heating elements to the recording sheet; and serving multiplication results for one line as said corrected heating data of said subject line.

5. The data processing method as claimed in claim 1, wherein step C comprises the steps of:

multiplying said original or said corrected heating data of said subject line by a coefficient to provide a first value for each pixel of said subject line;

multiplying said previously stored first heat accumulation data by a coefficient to provide a second value for each pixel of one line; and adding said first and second values and said second correction data in pixel-to-pixel correspondence, to provide a heat accumulation value for each pixel of one line, said heat accumulation values for one line serving as said new series of first heat accumulation data.

6. The data processing method as claimed in claim 1, wherein step E comprises the steps of:

multiplying said previously stored (J−1)th heat accumulation data by a coefficient to provide a third value for each pixel of one line;

multiplying said previously stored Jth heat accumulation data by a coefficient to provide a fourth value for each pixel of one line; and adding said third and fourth values and said (J+1)th correction data in pixel-to-pixel correspondence, to provide a heat accumulation value for each pixel of one line, said heat accumulation values for one line serving as said new series of Jth heat accumulation data.

7. The data processing method as claimed in claim 1, wherein step G comprises the steps of:

multiplying said previously stored (N−1)th heat accumulation data by a coefficient to provide a fifth value for each pixel of one line;

multiplying said previously stored Nth heat accumulation data by a coefficient to provide a sixth value for each pixel of one line; and adding said fifth and sixth values in pixel-to-pixel correspondence to provide a heat accumulation value for each pixel of one line, said heat accumulation values for one line serving as said new series of Nth heat accumulation data.

8. The data processing method as claimed in claim 1, wherein one of steps C, E and G further comprises the steps of:

filtering each heat accumulation value for one pixel with use of those heat accumulation values for adjacent pixels, said filtering step comprising the steps of:

multiplying said each heat accumulation value by a predetermined coefficient;

multiplying said heat accumulation values for the adjacent pixels by individual coefficients determined by relative positions of the adjacent pixels to said one pixel;

adding up multiplication results, to use a consequent sum as a filtered heat accumulation value for said one pixel; and serving said filtered heat accumulation values for one line as said new series of first, Jth or Nth heat accumulation data.

9. The data processing method as claimed in claim 5, wherein further comprising the steps of:

filtering said first values obtained from said original or said correction heating data of said subject line, to provide a correction value for each pixel of one line;

storing said correction values for one line during the recording of said subject line; and subtracting said correction values and said new series of first correction data from original heating data of the next line in pixel-to-pixel correspondence, to obtain corrected heating data of the next line.

10. The data processing method as claimed in claim 9, wherein said filtering step comprising the steps of:

multiplying said each first value by a coefficient;

multiplying said first values for said adjacent pixels by individual coefficients determined by relative positions of said adjacent pixels to said one pixel; and adding up multiplication results, to use a consequent sum as said correction value for said one pixel.

11. A data processing method for correcting heating data for a thermal head to eliminate influence of heat accumulation in the thermal head on recording density, the thermal head having an array of heating elements arranged in a line and first to Nth heat accumulating layers disposed under the heating elements in this order from the side of heating elements, the heating elements being driven by corrected heating data to print one line after another on a recording sheet, one pixel of each line being assigned to one heating element of the array in regular sequence, the method comprising the steps of:

A. obtaining first to Nth correction data for a subject line to print, from first to Nth heat accumulation data respectively, said first to Nth heat accumulation data being previously stored for one line and representative of respective thermal histories of said first to Nth heat accumulating layers relating to each heating element of the array;

B. correcting original heating data of said subject line with said first to Nth correction data for one line in pixel-to-pixel correspondence, to obtain corrected heating data of said subject line;

C. preparing a new series of first heat accumulation data based on said original or said corrected heating data of said subject line, and on said previously stored first heat accumulation data;

D. storing said new series of first heat accumulation data in place of said previously stored first heat accumulation data, during the recording of said subject line;

E. preparing a new series of Jth heat accumulation data, J being 2 to N, based on said previously stored (J−1)th heat accumulation data, and on said previously stored Jth heat accumulation data;

F. storing said new series of Jth heat accumulation data in place of said previously stored Jth heat accumulation data, during the recording of said subject line;

G. obtaining new series of first to Nth correction data from said newly stored first to Nth heat accumulation data, for use in correcting heating data of a next line to print; and H. repeating the above steps for each line to print.

12. The data processing method as claimed in claim 11, wherein step A comprises the steps of:

multiplying said previously stored first heat accumulation data by a first coefficient to provide said first correction data; and multiplying said previously stored second to Nth heat accumulation data by second to Nth coefficients to provide said second to Nth correction data respectively.

13. The data processing method as claimed in claim 11, wherein step B comprises the steps of:

subtracting said first to Nth correction data from said original heating data of said subject line in pixel-to-pixel correspondence; and serving subtraction results for one line as said corrected heating data of said subject line.

14. The data processing method as claimed in claim 11, wherein step B comprises the steps of:

subtracting said first to Nth correction data from said original heating data of said subject line in pixel-to-pixel correspondence; and multiplying subtraction results by a coefficient; and serving multiplication results for one line as said corrected heating data of said subject line.

15. The data processing method as claimed in claim 11, wherein step C comprises the steps of:

multiplying said original or said corrected heating data of said subject line by a coefficient to provide a first value for each pixel of said subject line;

multiplying said previously stored first heat accumulation data by a coefficient to provide a second value for each pixel; and adding said first and second values in pixel-to-pixel correspondence to provide a heat accumulation value for each pixel of one line, said heat accumulation values for one line serving as said new series of first heat accumulation data.

16. The data processing method as claimed in claim 11, wherein step comprises the steps of:

multiplying said previously stored (J−1)th heat accumulation data by a coefficient to provide a third value for each pixel of one line;

multiplying said previously stored Jth heat accumulation data by a coefficient to provide a fourth value for each pixel of one line; and adding said third and fourth values in pixel-to-pixel correspondence to provide a heat accumulation value for each pixel of one line, said heat accumulation values for one line serving as said new series of Jth heat accumulation data.

17. The data processing method as claimed in claim 15, wherein one of steps C and E further comprises the steps of:

filtering each heat accumulation value for one pixel with use of those heat accumulation values for adjacent pixels, said filtering step comprising the steps of:

multiplying said each heat accumulation value by a coefficient;

multiplying said heat accumulation values for said adjacent pixels by individual coefficients determined by relative positions of said adjacent pixels to said one pixel;

adding up multiplication results, to use a consequent sum as a filtered heat accumulation value for said one pixel; and serving said filtered heat accumulation values for one line as said new series of first or Jth heat accumulation data.

18. The data processing method as claimed in claim 15, wherein further comprising the steps of:

filtering said first values obtained from said original or said correction heating data of said subject line, to obtain a correction value for each pixel of one line;

storing said correction values for one line during the recording of said subject line; and subtracting said correction values and said new series of first to Nth correction data from original heating data of the next line in pixel-to-pixel correspondence, to obtain corrected heating data of the next line.

19. A data processing apparatus for correcting heating data for a thermal head to eliminate influence of heat accumulation in the thermal head on recording density, the thermal head having an array of heating elements arranged in a line and first to Nth heat accumulating layers disposed under the heating elements in this order from the side of heating elements, the heating elements being driven by corrected heating data to print one line after another, one pixel of each line being assigned to one heating element of the array in regular sequence, the apparatus comprising:

a correction means comprising subtracting means for subtracting first correction data from original heating data of a subject line to print, in pixel-to-pixel correspondence, to correct said original heating data; and first to Nth operation circuits provided in correspondence with the first to Nth heat accumulating layers respectively, wherein the first operation circuit comprises:

first memory means for storing first heat accumulation data for one line, the first heat accumulation data being representative of a thermal history of the first heat accumulating layer relating to each heating element of the array;

means for multiplying said stored first heat accumulation data by a coefficient to produce the first correction data;

means for multiplying said original or said corrected heating data of said subject line by a coefficient to provide a first value for each pixel of said subject line;

means for multiplying said stored first heat accumulation data by a coefficient to provide a second value for each pixel of one line; and first adding means for adding said first and second values in pixel-to-pixel correspondence, the first adding means being connected to the first memory means, to write a new series of first heat accumulation data in place of said previously stored first heat accumulation data, and wherein the Jth operation circuit, J being 2 to N, comprises:

Jth memory means for storing Jth heat accumulation data for one line, the Jth heat accumulation data being representative of a thermal history of the Jth heat accumulating layer relating to each heating element of the array;

means for multiplying said stored Jth heat accumulation data by a coefficient to provide Jth correction data;

means for multiplying (J−1)th heat accumulation data from the (J−1)th operation circuit by a coefficient to provide a third value for each pixel of one line;

means for multiplying said stored Jth heat accumulation data by a coefficient to provide a fourth value for each pixel of one line; and Jth adding means for adding said third and fourth values in pixel-to-pixel correspondence, the Jth adding means being connected to the Jth memory means, to write a new series of Jth heat accumulation data in place of said previously stored Jth heat accumulation data.

20. The data processing apparatus as claimed in claim 19, wherein the Jth correction data is sent to the (J−1)th operation circuit and is added at the (J−1)th adding means of the (J−1)th operation circuit.

21. The data processing apparatus as claimed in claim 19, wherein the Jth correction data is sent to said correction means, and is subtracted from said original heating data of said subject line.

22. The data processing apparatus as claimed in claim 19, wherein the first to Nth operation circuits further comprise first to Nth filtering means respectively, the first to Nth filtering means being connected between the first to Nth addering means, on one hand, and the first to Nth memory means, on the other hand.

23. The data processing apparatus as claimed in claim 19, further comprising a filter circuit having a filter for filtering said first value for each pixel of one line to obtain sub-correction data for one line, and a shift register for storing said sub-correction data for one line during the recording of said subject line, said sub-correction data for one line being sent to said correction means, to be subtracted from original heating data of a next line to print.

24. The data processing apparatus as claimed in claim 19, wherein said correction means further comprises means for multiplying each subtraction result from said subtracting means by a coefficient.

* * * * *